US005858529A

United States Patent [19]

Spijkers et al.

[11] Patent Number: 5,858,529

[45] Date of Patent: Jan. 12, 1999

[54] POLYESTER STAPLE FIBERS OF FILAMENTS WITH HIGH RESISTANCE TO PILLING

[75] Inventors: Joseph C. W. Spijkers, Haan; Eberhard Ruf, Rodenbach; Diederich Schilo, Klingenberg, all of Germany

[73] Assignee: Akzo Nobel NV, Arnhem, Netherlands

[21] Appl. No.: 894,690

[22] PCT Filed: Feb. 26, 1996

[86] PCT No.: PCT/EP96/00775

§ 371 Date: Nov. 13, 1997

§ 102(e) Date: Nov. 13, 1997

[87] PCT Pub. No.: WO96/27037

PCT Pub. Date: Sep. 6, 1996

[30] Foreign Application Priority Data

Mar. 2, 1995 [DE] Germany ..... 195 07 111.5

[51] Int. Cl.[6] ..... D02G 3/00; C08F 20/00

[52] U.S. Cl. ..... 428/364; 528/272; 528/302; 528/307; 528/308; 525/437; 525/448; 524/115; 524/222; 428/357; 428/359

[58] Field of Search ..... 528/272, 302, 528/307, 308; 525/437, 448; 524/115, 222; 428/357, 359, 364

[56] References Cited

U.S. PATENT DOCUMENTS

| | | | |
|---|---|---|---|
| 2,674,619 | 10/1953 | Lundsted . | |
| 3,669,933 | 6/1972 | King et al. | 528/296 |
| 4,134,882 | 1/1979 | Frankfort et al. | 528/309 |
| 4,211,678 | 7/1980 | Henry et al. | 524/605 |
| 4,467,595 | 8/1984 | Kramers | 57/225 |
| 4,496,716 | 1/1985 | Humbrecht et al. | 528/295 |
| 4,745,142 | 5/1988 | Ohwaki et al. | 524/87 |
| 5,097,004 | 3/1992 | Gallagher et al. | 528/272 |
| 5,156,906 | 10/1992 | Holland | 428/264 |
| 5,209,823 | 5/1993 | Jansma et al. | 162/146 |
| 5,239,019 | 8/1993 | Halling et al. | 525/437 |
| 5,295,985 | 3/1994 | Romesser et al. | 604/358 |

FOREIGN PATENT DOCUMENTS

| | | |
|---|---|---|
| A2 0-122623 | 10/1984 | European Pat. Off. . |
| 1-719213 | 3/1972 | Germany . |
| 2-113859 | 3/1972 | Germany . |
| A 54-120732 | 9/1979 | Japan . |
| A 55-16051 | 2/1980 | Japan . |
| A 55-90618 | 7/1980 | Japan . |
| A 60-224811 | 11/1985 | Japan . |
| A 1-124615 | 5/1989 | Japan . |
| A 3-45745 | 2/1991 | Japan . |

OTHER PUBLICATIONS

"Textile Testing", Jun. 1991, 4$^{th}$ Edition,Akzo Fibers Division, Wuppertal, Germany.

*Primary Examiner*—Samuel A. Acquah
*Attorney, Agent, or Firm*—Oliff & Berridge, PLC

[57] ABSTRACT

Polyester staple fibers with high resistance to pilling contain (1) a polyester component consisting of at least 90 mol % polyethylene terephthalate, after its polycondensation, and (2) 1 to 7% by weight, relative to the polyester component, of a polyalkylene glycol block polymer with the formula $$HO(CH_2-CH_2-O)_a(\underset{\underset{CH_3}{|}}{CH}-CH_2-O)_b(CH_2-CH_2-O)_cH$$

in which the polyoxypropylene core has a mean molecular weight of 3000 to 4000 and a, b and c are integers such that the polyoxyethylene groups form 20 to 60% by weight of the block polymer, which has a mean molecular weight of 3750 to 10000. The staple fibers are prepared by admixing the polyester component and the block copolymer evenly in a separate phase and spinning the two together in the usual manner. The polyester component preferably is polyethylene terephthalate homopolyester, to which 2–4% by weight of the block copolymer is admixed.

16 Claims, No Drawings

POLYESTER STAPLE FIBERS OF FILAMENTS WITH HIGH RESISTANCE TO PILLING

BACKGROUND OF THE INVENTION

The invention relates to polyester staple fibers or filaments with high resistance to pilling and a process for manufacturing them.

One of the most unpleasant phenomena brought about by the use of polyethylene terephthalate fibers in the textile industry, at first quite unexpected and confronting manufacturers of synthetic fibers with problems that are not even fully solved today, is pilling. Pilling is understood to mean the formation of small balls of fiber which arise on the textile by the fiber ends wandering out of the fabric structure and which are very detrimental to the appearance of the garments. The fibers holding the pills to the basic fabric do not break off because the polyester fibers have a far higher flexing abrasion resistance than the natural fibers so that the small balls of fiber or naps remain clinging to the fabric.

A known measure to counter pilling is the manufacture of polyesters with a low molecular weight or a low solution viscosity, which decreases the strength of the fiber to such an extent that the fiber ends and pills which have emerged break off rapidly as in the case of natural fibers. However, the reduction of about 40% in the fiber's strength makes it very susceptible to damage during the further processing of such fibers, so that this type of anti-pilling fiber can no longer be processed in the three-roller and rotor spinning mills at the same speeds and with the same efficiency as normal types of cotton.

From DE-OS 17 19 213, the process is known of admixing a combination of defined polyalkylene glycols and alkaline or alkaline earth salts of organic sulfonic acids to the polyethylene terephthalate after its polycondensation to deal with the problem of pilling. It is noted here that adding only polyalkylene ether of the type defined therein has practically no effect, but that serious faults occur during spinning and weaving processes.

To solve the problem of pilling, DE-OS 21 13 859 discloses the procedure of adding defined polyalkylene glycols to the initial components which form the polyester either before or after the transesterification reaction. Since these glycols are condensed into the polyester, a not inconsiderable number of the desired properties of the polyethylene terephthalate are altered, not to mention the fact that in this type of polyester it is sometimes very difficult to avoid producing an undesired three-dimensional structure.

To avoid the problem of pilling, JP-OS 54-120 732 suggests the admixture of 0.5 to 15% by weight, preferably 2–10% by weight, polyethylene glycol with a molecular weight of 300–4000 to the polyethylene terephthalate after its polycondensation. Studies have shown that the flexing abrasion resistance of fibers manufactured from this mixture is still far too high to produce a satisfactory pilling-resistant polyester fiber (see Comparative Example 2).

SUMMARY OF THE INVENTION

The object of the present invention is to provide polyester staple fibers or filaments with high resistance to pilling, whose flexing abrasion resistance is considerably reduced, while the tensile strength of the fibers is at best only moderately reduced, i.e. by less than 10%, so that they may be further processed without any damage to the fibers in the same manner as for normal types of cotton.

The subject of the invention is polyester staple fibers or filaments with high resistance to pilling, which are characterized in that they contain (1) a polyester component consisting of at least 90 mol % polyethylene terephthalate, and (2) 1 to 7% by weight, relative to the polyester component, of a polyalkylene glycol block polymer with the formula $$HO(CH_2-CH_2-O)_a(\underset{\underset{CH_3}{|}}{CH}-CH_2-O)_b(CH_2-CH_2-O)_cH$$

in which the polyoxypropylene core, as a hydrophobic base, has a mean molecular weight of 3000 to 4000, and a, b and c are integers such that the hydrophilic polyoxyethylene groups joined to the core at the sides form 20 to 60% by weight of the total polyalkylene glycol block polymer, which has a mean molecular weight of 3750 to 10000.

DETAILED DESCRIPTION OF PREFERRED EMBODIMENTS

The polyester component is to consist of at least 90 mol % polyethylene terephthalate. It can then contain up to 10 mol % of units derived from at least one further polyester-forming component. Components which may be considered are an aliphatic diol such as butylene glycol and hexamethylene glycol, an alicyclic diol such as 1,4-cyclohexanedimethanol and cyclohexane diol, an aliphatic dicarboxylic acid such as adipic acid and sebacic acid, an aromatic dicarboxylic acid such as 2,6-naphthalene dicarboxylic acid and sodium sulfoterephthalic acid and an alicyclic dicarboxylic acid such as hexahydroterephthalic acid and 1,3-cyclohexane dicarboxylic acid. However, it is preferable for the polyester component to consist of the homopolyester polyethylene terephthalate. Apart from this, it is by nature irrelevant to this invention whether the polyesters under consideration have been manufactured by a transesterification process or by a direct esterification process.

The specific polyalkylene glycol block polymers defined above are described in U.S. Pat. No. 2,674,619, which is incorporated herein by reference. In the scope of this invention, polyalkylene glycol block polymers are preferred in which the polyoxypropylene core has a mean molecular weight of 3000 to 3400 and the hydrophilic polyoxyethylene groups form 30 to 50% by weight of the total polyalkylene glycol block polymer, which has a mean molecular weight of 4200 to 6800. Naturally, it is also possible to use mixtures of polyalkylene glycol block polymers which are within the limits of those specific block copolymers that can be considered, as defined above.

It is advantageous for the polyalkylene glycol block polymer component to contain 3–12% by weight phenolic antioxidants or antioxidants consisting of organic phosphorus compounds. The following compounds (and mixtures of these) are possible: (5-tert-butyl-4-hydroxy-3-(methylbenzyl)-malonic acid-di-n-octa-decylester, octadecyl-3-(3,5-di-tert-butyl-4-hydroxy-phenyl)-propionate, 1,3,5-trimethyl-2,4,6-tris-(3,5-di-tert-butyl-4-hydroxy-benzyl)-benzene, N,N'-hexamethylene-bis-(3,5-di-tert-butyl-4-hydroxy-hydrocinnamic amide), pentaerythrityl-tetrakis-[3-(3,5-bis-(1,1-methyl)-4-hydroxy-phenyl)-propionate], 1,1-bis-(5-tert-butyl-4-hydroxy-2-methyl-phenyl)-butane, bis-(2,4-di-tert-butylphenyl)-pentaerythritol-diphosphite, 3,5-di-tert-butyl-4-hydroxybenzyl-phosphonic acid-diethylester and 3,5-di-tert-butyl-4-hydroxybenzyl-phosphonic acid-di-n-octadecylester.

A preferred embodiment of the invention is formed as follows: the admixed polyalkylene glycol block polymer contains 6–10% by weight pentaerythrityl-tetrakis-[3-(3,5-bis-(1,1-methyl)-4-hydroxy-phenyl)-propionate], 1,3,5-trimethyl-2,4,6-tris-(3,5-di-tert-butyl-4-hydroxy-benzyl)-benzene, N,N'-hexamethylene-bis-(3,5-di-tert-butyl-4-hydroxy-hydrocinnamic amide) or bis-(2,4-di-tert-butylphenyl)-pentaerythritol-diphosphite.

An essential characteristic of the invention is that a consistent amount of 1–7% by weight, relative to the polyester component, of the polyalkylene glycol block polymer component is admixed evenly in a separate phase and only after the polycondensation of the polyester component, after which spinning is conducted in the usual manner. Surprisingly, even with a small addition of 2–4% by weight of the polyalkylene glycol block polymer component, it is possible to manufacture fibers with high resistance to pilling, i.e., low flexing abrasion resistance, and also other good technical textile properties, especially good fiber tensile strengths, if the polyoxypropylene core has a mean molecular weight of 3000 to 3400 and the hydrophilic polyoxyethylene groups form 30 to 50% by weight of the total polyalkylene glycol block polymer, which has a mean molecular weight of 4200–6800.

It is preferable for mixing to be conducted in a molten state, using the known equipment suitable for mixing high-viscosity materials. Both static mixers, such as those with folded or twisted sheet metal, diagonal bores, openings or sphere packing, and dynamic mixers can be considered. Whereas static mixers do not possess any moving parts, dynamic mixers such as extruders and twin screw extruders possess moving mixing implements.

In a preferred embodiment, the molten polyalkylene glycol block polymer is mixed with the molten polyester component, preferably polyethylene terephthalate, using a dynamic and a static mixer directly before spinning. For this purpose the polyalkylene glycol block polymer component is fed as melt into the melt line between the polycondensation end reactor and the spin-die manifold and initially mixed with the molten polyester stream using a dynamic mixer. Before entering the pump block of the spinning system the melt of polyester and polyalkylene glycol block polymer is homogenized once again using a static mixer.

The filaments, spun and drawn in the usual manner at the usual solution viscosities, which for polyethylene terephthalate fibers are, e.g., 1.5–1.7, and with substantially normal technical textile properties, have a flexing abrasion resistance of much fewer than 1000 stroke cycles before breaking, which represents a characteristic associated with high pilling resistance. Normal polyethylene terephthalate fibers which are not resistant to pilling have a flexing abrasion resistance of 3500 to 5000 stroke cycles.

The test for flexing abrasion resistance was conducted in accordance with the method described in the brochure by Stefan Kleinheinz entitled "Textile Prüfungen" ("Textile tests") (June 1991, 4th edition, Akzo Fibers Division, Wuppertal, Germany). In this method, single fibers under defined tension and with a wrap angle of 110° are moved to and fro over a thin steel wire until they break off. Since the diameter of the steel wire is on the same order of magnitude as the diameter of the fiber (20–40 mm), there is strong flexing stress in addition to the purely abrasive action. The result is then the number of stroke cycles before the fiber breaks (one to-and-fro movement=1 stroke cycle).

Since there is a strong dependence on the tension, the diameter of the wire and the titer of the fiber, only results which take these factors in account are comparable. The polyester fibers manufactured in the examples with a single titer of 1.5 dtex were tested under a tension of 4.5 cN/tex against 20 mm wire. The relative solution viscosity stated in the examples was measured at 25° C. as a 1% by weight solution in meta-cresol.

The invention will be explained in more detail with the aid of the following examples:

EXAMPLES 1–3

After the direct esterification or transesterification process, polyethylene terephthalate melt is polycondensed continuously and fed through a melt line after the end reactor into the spinning system. Discontinuous condensation with the production of chips and subsequent melting with the aid of an extruder may also be employed here.

In three independent experiments, 2, 3 and 4% by weight respectively, relative to the polyethylene terephthalate used, of a polyalkylene glycol block polymer whose polyoxypropylene core has a mean molecular weight of 3250 and whose polyoxyethylene groups form 50% by weight of the block polymer are fed into the melt line between the end reactor (or extruder) and the spin-die manifold, and using a dynamic mixer, e.g., a 3DD (three dimensional dynamic) mixer manufactured by Barmag, are mixed with the polyester melt stream. The mean molecular weight of the block polymer is 6500 in this case. Before entering the pump block of the spinning system the polyester and block polymer melt is homogenized once again using a static mixer, e.g., a Sulzer SMX mixer, in order to guarantee that all spinning locations are charged with a product of the same composition, which is necessary to obtain polyester fiber of uniform quality. For the subsequent spinning, fiber spinnerets with 2000 holes per spinneret are employed. The drawing-off speed is in the range of 1200–1500 m/min. After assembly beaming of the single tows to an overall tow the latter is deposited in a can system and fed to the drawing frame for further treatment.

Drawing is conducted in two stages using septets. Before entering the first septet the tow is coated with finishing agent in a bath. Following the septets there is a calender which serves to fix the tow at low shrinkage values of about 4–5% hot-air shrinkage (at 190° C.). For this purpose, the rollers are heated to about 220° C.

After the fixing process the tows are cooled, relaxed, arranged in layers and, after renewed treatment with finishing agent, subjected to crimping in the crimper. The crimper is immediately followed by drying in a drying conveyor, for which reason the tow is made to traverse from side to side to provide sufficient retention time in the dryer. After this the tow is cut and the flock compressed in a baling press and packed automatically.

Settings:

Spinning:

| | |
|---|---|
| Relative solution viscosity of the PET | 1.63 |
| Concentration of EO-PO block polymer (EO = ethylene oxide, PO = propylene oxide) | 2, 3 and 4 wt. % |
| Spinning temperature | 290° C. |
| Spinneret: number of holes, hole diameter | 2000/250 μm |
| Throughput | 1300 g/min |
| Spinning speed | 1200 m/min |
| Air flow delivery volume | 1100 $m^3$/h |

-continued

| Drawing: | |
|---|---|
| Drawing speed | 100 m/min |
| Drawing ratio (two-stage) | 1:2.8/3.4–3.7 |
| Relaxation | 2% |
| Fixing (5-roller calender) | 220–230° C. |

Textile data (fibers after crimping):

| Example No. | | 1 | 2 | 3 |
|---|---|---|---|---|
| Concentration ot EO-PO block polymer (EO = ethylene oxide, PO = propylene oxide) | wt. % | 2 | 3 | 4 |
| Drawing ratio | 1: | 2.8/3.4 | 3.0/3.6 | 2.8/3.4 |
| Fixing temperature | °C. | 225 | 230 | 225 |
| Single titer | dtex | 1.5 | 1.5 | 1.5 |
| Tensile strength | cN/tex | 49 | 53 | 47 |
| Elongation | % | 39 | 23 | 36 |
| Modulus (10% elongation) | cN/tex | 35 | 41 | 32 |
| Hot-air shrinkage (190° C.) | % | 4 | 4.6 | 4 |
| Flexing abrasion resistance | stroke cycles | 900 | 750 | 400 |

EXAMPLE 4

The method of Example 1 was repeated in identical fashion except that 2% by weight, relative to the polyethylene terephthalate used, of a polyalkylene glycol block polymer whose polyoxypropylene core has a mean molecular weight of 3250 and whose polyoxyethylene groups form 30% by weight of the block polymer is fed into the melt line between the end reactor and the spin-die manifold. The mean molecular weight of the block polymer is about 4600 in this case. The fibers thus obtained had a flexing abrasion resistance of 610 stroke cycles. Their tensile strength was 45.9 cN/tex, and their elongation was 26.8%.

COMPARATIVE EXAMPLE 1

The method of Example 1 was repeated in identical fashion except that 2% by weight, relative to the polyethylene terephthalate used, of a polyalkylene glycol block polymer whose polyoxypropylene core has a mean molecular weight of 1750 and whose polyoxyethylene groups form 50% by weight of the block polymer is fed into the melt line in a controlled manner between the end reactor and the spin-die manifold. Although the fibers thus obtained have a tensile strength of 47.5 cN/tex and an elongation of 26.7%, their flexing abrasion resistance is 2438 stroke cycles. The fact that the flexing abrasion resistance is too high shows that these fibers possess an inadequate resistance to pilling.

COMPARATIVE EXAMPLE 2

The method of Example 1 was repeated in identical fashion except that 2% by weight, relative to the polyethylene terephthalate used, of a polyalkylene glycol block polymer whose polyoxypropylene core has a mean molecular weight of 4000 is dosed into the melt line between the end reactor and the spin-die manifold. Although the fibers thus obtained have a tensile strength of 46.3 cN/tex and an elongation of 28.1%, their flexing abrasion resistance is 4300 stroke cycles. This flexing abrasion resistance shows, however, that these fibers do not possess any resistance to pilling at all.

What is claimed is:

1. Polyester staple fibers or filaments with high resistance to pilling, wherein the staple fibers or filaments comprise (1) a polyester component comprising at least 90 mol % polyethylene terephthalate, and (2) 1 to 7% by weight, relative to the polyester component, of a polyalkylene glycol block polymer having a hydrophobic polyoxypropylene core and polyoxyethylene groups joined to the core, and having the formula $$HO(CH_2-CH_2-O)_a(\underset{\underset{CH_3}{|}}{CH}-CH_2-O)_b(CH_2-CH_2-O)_cH$$

in which the polyoxypropylene core has a mean molecular weight of 3000 to 4000, and a, b and c are integers such that the polyoxyethylene groups joined to the core form 20 to 60% by weight of the total polyalkylene glycol block polymer, and wherein the block copolymer has a mean molecular weight of 3750 to 10000.

2. Polyester staple fibers or filaments in accordance with claim 1, wherein the staple fibers or filaments contain 2 to 4% by weight of the polyalkylene glycol block polymer.

3. Polyester staple fibers or filaments in accordance with claim 1, wherein the polyoxypropylene core in the polyalkylene glycol block polymer has a mean molecular weight of 3000 to 3400 and the hydrophilic polyoxyethylene groups form 30 to 50% of the total polyalkylene glycol block polymer, and wherein the block copolymer has a mean molecular weight of 4200 to 6800.

4. Polyester staple fibers or filaments in accordance with claim 1, wherein the polyester component is polyethylene terephthalate.

5. Polyester staple fibers or filaments in accordance with claim 1, wherein the staple fibers or filaments contain, relative to the polyalkylene glycol block polymer component, 3–12% by weight phenolic antioxidants or antioxidants of organic phosphorus compounds.

6. Polyester staple fibers or filaments in accordance with claim 5, wherein the staple fibers or filaments contain, relative to the polyalkylene glycol block polymer component, 6–10% by weight pentaerythrityl-tetrakis-[3-(3,5-bis-(1,1-methyl)-4-hydroxy-phenyl)-propionate], 1,3,5-trimethyl-2,4,6-tris-(3,5-di-tert-butyl-4-hydroxy-benzyl)-benzene, N,N'-hexa-methylene-bis-(3,5-di-tert-butyl-4-hydroxy-hydrocinnamic amide) or bis-(2,4-di-tert-butylphenyl)-pentaerythritol-diphosphite.

7. Polyester staple fibers or filaments in accordance with claim 1, wherein the staple fibers or filaments have a flexing abrasion resistance of less than 1000 stroke cycles.

8. Polyester staple fibers or filaments in accordance with claim 1, wherein the polyester component contains up to 10 mol % of an aliphatic diol, an alicyclic diol, an aliphatic dicarboxylic acid, an aromatic dicarboxylic acid, an alicyclic dicarboxylic acid, or mixtures thereof.

9. Polyester staple fibers or filaments in accordance with claim 1, wherein the polyester component comprises at least 90 mol % polyethylene terephthalate following condensation of the polyester.

10. Process for the manufacture of polyester staple fibers or filaments with high resistance to pilling, the process comprising evenly admixing in a separate phase (1) a polyester component comprising at least 90 mol % polyethylene terephthalate, and (2) 1 to 7% by weight, relative to the polyester component, of a polyalkylene glycol block polymer having a hydrophobic polyoxypropylene core and polyoxyethylene groups joined to the core, and having the formula $$HO(CH_2-CH_2-O)_a(\underset{\underset{CH_3}{|}}{CH}-CH_2-O)_b(CH_2-CH_2-O)_cH$$

in which the polyoxypropylene core has a mean molecular weight of 3000 to 4000, and a, b and c are integers such that the hydrophilic polyoxyethylene groups joined to the core form 20 to 60% by weight of the total polyalkylene glycol block polymer, wherein the block copolymer has a mean molecular weight of 3750 to 10000, and spinning the admixture obtained to form the staple fibers or filaments.

11. Process in accordance with claim 10, wherein the polyalkylene glycol block polymer in the form of a melt is mixed with the molten polyester component using a dynamic mixer and a static mixer immediately prior to spinning.

12. Process in accordance with claim 10, wherein 2–4% by weight of the polyalkylene glycol block polymer is admixed with the polyester component.

13. Process in accordance with claim 10, wherein the polyalkylene glycol block polymer is admixed with polyethylene terephthalate.

14. Process in accordance with claim 10, wherein the polyoxypropylene core in the polyalkylene glycol block polymer has a mean molecular weight of 3000 to 3400 and the hydrophilic polyoxyethylene groups form 30 to 50% by weight of the total polyalkylene glycol block polymer, and wherein the block copolymer has a mean molecular weight of 4200–6800.

15. Process in accordance with claim 10, wherein the polyalkylene glycol block polymer contains 3–12% by weight phenolic antioxidants or antioxidants of organic phosphorus compounds.

16. Process in accordance with claim 15, wherein the polyalkylene glycol block polymer contains 6–10% by weight pentaerythrityl-tetrakis-[3-(3,5-bis-(1,1-methyl)-4-hydroxy-phenyl)-propionate], 1,3,5-trimethyl-2,4,6-tris-(3,5-di-tert-butyl-4-hydroxy-benzyl)-benzene, N,N'-hexamethylene-bis-( 3,5-di-tert-butyl-4-hydroxy-hydrocinnamic amide) or bis-(2,4-di-tert-butylphenyl)-pentaerythritol-diphosphite.

* * * * *